United States Patent [19]

Eckberg

[11] 4,158,153

[45] Jun. 12, 1979

[54] LOW VOLTAGE FLUORESCENT LAMP HAVING A PLURALITY OF CATHODE MEANS

[76] Inventor: Edwin E. Eckberg, 5504 Currier Cir., Boise, Id. 83705

[21] Appl. No.: 871,605

[22] Filed: Jan. 23, 1978

[51] Int. Cl.[2] ..... H01J 61/067; H01J 61/42; H01J 61/54

[52] U.S. Cl. ..... 313/491; 313/113; 313/208; 313/209

[58] Field of Search ..... 313/491, 209, 113, 208

[56] References Cited

U.S. PATENT DOCUMENTS

| | | | |
|---|---|---|---|
| 2,561,868 | 7/1951 | Jenkins et al. | 313/220 X |
| 2,847,605 | 8/1958 | Byer | 313/491 |
| 2,911,376 | 11/1959 | Rudolph | 313/491 X |

*Primary Examiner*—Palmer C. Demeo
*Attorney, Agent, or Firm*—Robert F. O'Connell

[57] ABSTRACT

A new low voltage fluorescent light bulb is described. The bulb operates in a screw type socket on single-phase alternating current. No ballast is required. The lumen output of the new bulb is more than twice that of a filament type light bulb of equal input electrical energy. It has a life expectancy greater than 25,000 hours of useful operation. Hence, besides a substantial savings of electrical energy, the bulb pays for itself over time. Also, this new fluorescent light bulb saves the electrical energy and materials that would be entailed if the filament type of light bulb remains in use over the same extended time period. The new bulb is an ionic gas and mercury vapor discharge device of the uniformly restricted positive column type. However, a plurality of paired and matched self-polarizing positive column discharge tubes are used. The latter as connected, electrically, in a series-parallel manner are using the full wave of the input current; each positive column discharge tube becomes one of unidirectional current flow. It uses only one-half of the input wave, and its other matching and polarized tube takes the other half of the same input wave. This presents one attractive feature, or that of power-factor correction. (Power-factor losses are inherent to all other types of fluorescent lighting devices because of the necessity of the auxilliary ballast equipment.)

5 Claims, 10 Drawing Figures

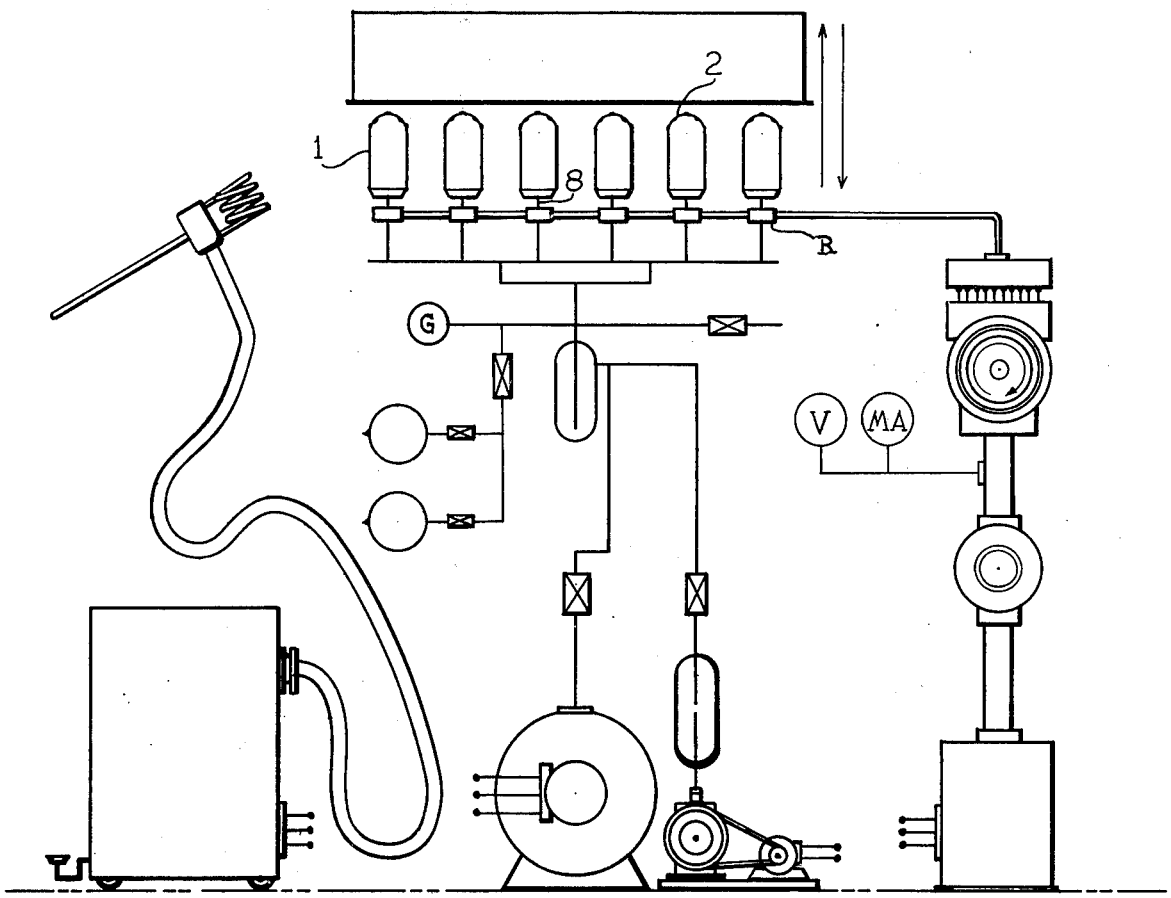

LEGEND

Fig. 7.

| SYMBOL | DESCRIPTION | SYMBOL | DESCRIPTION |
|---|---|---|---|
| | LOW VOLTAGE BULBS | | RSV PUMP |
| | MANIFOLD | | LOW VOLTAGE AUTO-TRANSFORMER |
| | RECEPTACLE, ELEC. ADAPTOR R | MET. | ELECTRIC METER |
| | OVEN LOCATION "UP" | | HIGH FREQUENCY INDUCTION UNIT |
| | VACUUM VALVE | | INDUCTION HEATER "EXTERNAL" COIL |
| | TRAP (NOT USED WITH USV PUMP) | | FOOT PEDAL, REMOTE CONTROL-FLEXIBLE |
| | RARE GAS SUPPLY - FLASK | | ROTARY AUTOSWITCH (MOT. DRIVE) |
| | "UP" "DOWN" OVEN POSITIONS | | ELECTRIC POWER SUPPLY AND CONTROL |
| G | VACUUM GAUGE | | TEN (10) CONDUCTOR CABLE TO BULBS |
| | COPPER FOIL OIL TRAP | | FLOOR-LINE |
| | U S V PUMP U.S. PAT. 3104802 | | CURRENT CONTROL (100 to 500 MA) |

LOW VOLTAGE FLUORESCENT LAMP HAVING A PLURALITY OF CATHODE MEANS

My invention relates to improvement in low voltage fluorescent light bulb devices and more particularly to a multiple series-parrallel array of ultraviolet source tubes selfcontained in my bulb; also a low voltage fluorescent light bulb that is designed to effect substantial electrical energy savings in use.

The objects of my invention are to produce a long life expectancy low voltage fluorescent light bulb that requires no auxilliary ballast and one that furnishes a luminous output that is substantially greater than that of present-day state of the art incandescent filament light bulbs. Also a fluorescent light that radiates a daylight spectral light having, generally, a minimum of shadow effect proximate to objects which the fluorescent bulb illuminates.

Another object is the elimination of all radio and television signal interference to nearby radio and television units.

Still another object is to provide an inherently fail-safe operative life to my fluorescent light bulb such that it furnishes reliable and useful illumination well beyond the established life expectancy (established/approximated at 25,000 hours).

These and other objects will present themselves and become apparent from my specifications and the appended drawings in which FIG. 1 is an outline drawing of the completed low voltage fluorescent light bulb;

Figure 6:
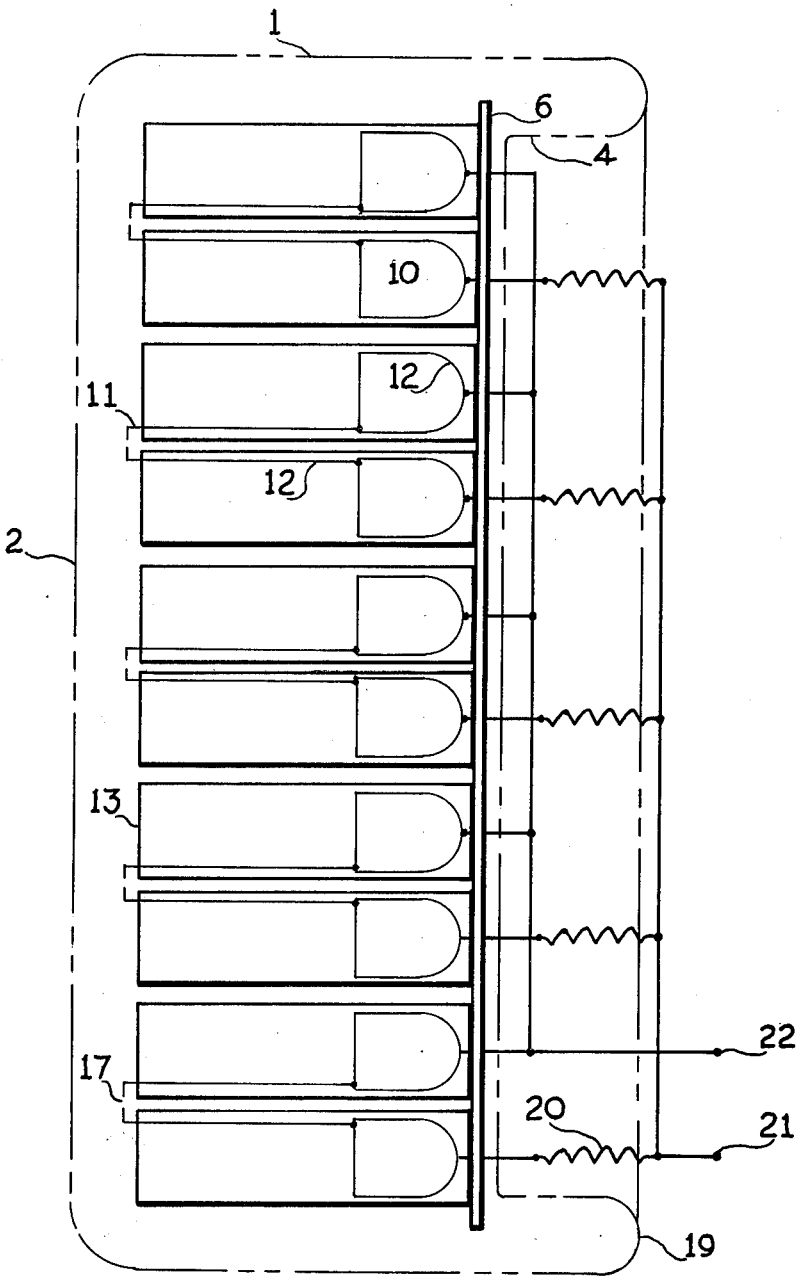

FIG. 6 is an electrical schematic of the low voltage fluorescent light bulb. This sketch is made in an unfolded manner. It applies to all sizes of the low voltage fluorescent light bulb, and FIG. 7 is a sketch of the vacuum system and electrical power units required for the processing of the low voltage fluorescent light bulb. A legend is a part of this drawing to define the symbols used. FIG. 7 is a reference drawing and is used in the text of this specification.

My invention, the low voltage fluorescent light bulb, comprises a cylindrical glass envelope 1 having a closed and formed top 2. The internal surface of the envelope 1-2 is uniformly coated with a suitable phosphor, 3. A flared reentrance stem member 4 is provided with glass beaded and fused leadwires or vacuum tight feedthrough leads 5 used to support the assembly, or structure, within the vacuum tight bulb envelope 1. A thin disc member, 6 is provided as a platform member; this platform is either glass or alumina. Platform member 6 is slotted or perforated with throughholes, 7, allowing feedthrough leadwires 5 to pass upwardly and through platform member 6. A small glass tubulation member, 8, is an integral part of stem member 4, and it is provided for the processing of the bulb when the latter is completely assembled and is ready for ultra high evacuation treatment. Following the process of evacuation and treatment the tubulation member 8 is tipped off, or sealed at location 9. The pattern of the slots or throughhole members 7 is similar to that of the feedthrough leads 5. Hollow cathode members 10 are provided and are welded (electric spotweld) to feedthrough leadwires 5, directly above the platform member 6. Cathode extension members 11 are provided; having uniform cross-sectional area, and cut to precise and suitable length. The cathode extensions are welded to the top brim of each of the cathode members 10, and their top ends, respectively, become "cathodic-anodic" (alternately) during ionic discharge of the low voltage fluorescent light bulb's operation. The entire inside surface of the hollow cathode members 10 and the entire surfaces of the cathode extension members 11 are thinly and uniformly coated with an electron emissive chemical mixture 12. Clear fused quartz tubular members 13 are provided; they are squarely cut at both ends, and have equal length and uniform cross-sectional inside area. These quartz tubes are positioned over each of cathode members 10, the latter fitting the confines of the quartz tubes in a relatively close manner. A right cylindrical glass member 14 is provided to act both as a support-guide for the positioning of all quartz tube members 13; also, with the exterior lateral surface of it being front-surface aluminum thin-filmed as reflector member 15. A hollow glass or alumina member, specially formed and of micro-dimensional size and precision as formed, spacer member 16, is provided at the top of each pair of quartz tubes 13 at the latter's point of tangency to one another. The upper ends of cathode extension members 11 are passed upwardly and through the hollowed central portion of spacer members 16, whereat they are held in a close and minute separation. (IMPORTANT NOTE: This separation cannot be less than one one-hundredth millimeter, nor in excess of five one-hundredths of one millimeter.) The separation as just set forth becomes the starting gap member 17 of each pair of quartz tube members 13. The upper ends of all members 11 are bent over the sidewalls of spacer member 16 and are affixed there with a small droplet of alumina or ceramic cement, member 18. The bonding cement member 18 is used, severally, at other locations in the bulb. At this stage the assembly or the bulb's completed mount structure is completed. It is now inserted into the envelope member 1 and, by glassblowing, is attached to the envelope and provides the main seal 19 of the bulb. It is a simple glassblowing operation. When the processing schedule of evacuations, purifications, and conversion of electron emissive chemical coating, member 12, is completed the bulb is ready for the simple electrical connecting of the power or current control member 20. This current control unit is required for each pair of the ultra violet discharge tubes, as connected and as involving the lower ends of the feedthrough leadwire members 5. Electrical connections (several) are members 21 and 22, respectively. (See FIG. 6.) The final attachment of the screw-type base member 23 is now effected, using cement member 18, or a suitable alternate material such as bakelite cement.

The materials which I have tested and selected for the construction of the low voltage fluorescent light bulb are called out in the following: The bulb's envelope is of clear soda-lime soft grade glass; its specially shaped dome closure being formed by the manufacturer. The stem, which can be either of the reentrance type or the flat wafer type is of soft soda grade glass.

The beading glass, which is fused to the leadwires or feedthrough leads is also soda grade glass. The tubular positive column, as stated in the above enumerated details, is clear fused quartz. It is of the grade that has the better clarity, and the higher transmissive factor for ultra violet light radiations; also it is of a closely held tolerance with respect to its inside diameter. For the platform, either a glass or an alumina disc may be used. It is advisable when the glass is used that its lower surface be thinly covered with a porcelain or ceramic type of bakable cement. The determination to use pure soft nickel for the cathodes was after several other base metals were given a thorough test. Series #302 stainless steel is a suitable substitute, but it does not lend itself to the shaping required for this work. The cathode extensions are also of pure nickel. The feedthrough wires, as beaded, is of that category well known to the trade as dumet. It is a modified copperclad iron wire that is borated (red color). The electron emissive coating is a mixture of the following chemicals, all are carbonates: Strontium, barium, and calcium. Their precise proportional amounts, respectively, remain a trade secret. It has been interesting to observe that when the barium (carbonate) may be increased above that of the manufacturer's proportion, the voltage drop for most cathodes is decreased. On the other hand, the factor of sputtering is increased—excepting in the one case of a dominant vapor discharge of mercury. Hence it is practiced, here, to add approximately 40 to 50 grams of the barium carbonate to each liter of parent (manufacturer's) solution. The vehicle is amylacetate, and it can be used to provide suitable dipping or spraying conditions. It must be thoroughly dried. It is, of course, poisonous and should be handled with care. Inhalation, if the spraying method is used, must be avoided. Similarly, the chemical mixture for the fluorescent coating is a physical mixture. Several shades of white are available. I prefer the 3500° WHITE. Other colors that can be used are: green, blue, rose and yellow. (In the case of yellow, the envelope of the bulb would then have to be a lemon-yellow glass.) The tubulations for the bulbs are of a soft grade soda glass. It is obvious that this tubulation also serves as a blow-in port tube during the main sealing of the bulb. The mercury used must be so-called triple distilled. The filling gas can be argon, argon-neon (90% 10%, resp.) or, possibly, xenon-argon (10% 90%, resp.). The current control units are of the wire wound resistor type, and are practically non-inductive. They are ceramic coated. Other materials may be used than those stated. Indeed, many of the early test bulbs were of boro-silica glass. Nickel round wire is indicated for certain supporting requirements. The metal parts should be hydrogen furnace treated to insure high purity having oxygen-free characteristics. Finally, during glassblowing, usually machine work of the semi-automatic type, a gas well-known to the trade as "forming gas" should be used to prevent oxidation of the parts during the glassblowing period. Thorough annealing, especially when soft grade glasses are used, is necessary. Preconversion of the electron emissive coatings is possible, but when it is practiced it becomes necessary to dessicate the parts (preferably under evacuated conditions, with an enert gas partial atmosphere such as helium, or even dry nitrogen gas.). Desication, however, can be omitted if the preconverted parts are completed and processed within a twelve to sixteen hour period of time.

GENERAL; RELATED TO IONIC DISCHARGE

Generally the life expectancy of an ionic discharge is directly related to the rate of gas or vapor clean up taking place during the operation of the discharge, over time. Obviously it will increase the rate of clean up if the current be increased to any appreciable degree. Assuming any given self-sustaining ionic discharge to be taking place at an optimum current level for that particular unit, it has been observed that the relatively heavier mass ions which bombard the cathode actually vaporize cathodic particles. These particles, in turn, as they cool down will then absorb (occlude) molecules of the gas or vapor provided in the unit for ionic discharge. This depletion effects lower pressures. It is often termed sputtering. Hence, disintegration of the cathode material and gas clean up rates are considered as being directly related to the current density applied to the ionic discharge device. This, as stated, continues over the entire life of the discharge tube unless some provision is made to regulate or cancel out the cathodic disintegration.

A solution to this problem of sputtering resides in the simple fact that when the area and shape (geometrically) of the cathode is ideal for one given level of ionic discharge current, it follows that the current density is observed as being uniform over the entire surface of the cathode. This condition of a uniform current density invites resputtering. Therefore, even though some sputter takes place it is balanced (even cancelled out) by resputtering. Therefore, my cathode design used in the low voltage fluorescent light bulb is one that has a uniform current density over its entire cathodic surface.

To attain the condition of uniform current density it is essential to provide cathode and cathode extension materials of the highest purity. Likewise the chemicals used for the electron emissive materials. The fabrication operations must closely adhere to the dimensions specified in the finalized design, and all physical considerations, such as a "dust-free" area, humidity level and temperature range must be given serious thought and a positive control.

One final remark regarding uniform current density. It may appear that my use of the cathode extensions, and their gaps would be one obstacle that would prevent the attainment of uniform current density. This, at first, proved to be true. And, at that period during my development work, oscilliscopic observations and subsequent age testing of the extension design (at that time) confirmed that slight sputter did occur, especially at the gap. It was a slow sputter rate (since only about $1.0\times10^{-4}$ Hz was involved) but it was decided to eliminate this slight degree of sputter. The spacer for microdimensional control of the gap proved to be one solution. Sputtering still occurs, but it is within the smooth confines of the gap spacer and is presently resputtered. The rest of the discharge tube (quartz tube, cathode extension and cathode) do not evidence any sputter. The dome (top) of the bulb remains clean, over time, and emits a uniform fluorescent light. There is no solarization on the fluorescent walls inside the bulb. This is added evidence of a state of high purity, and uniform current density for the operation of the low voltage fluorescent light bulb.

SPECIFICS; RELATED TO IONIC DISCHARGE

Since the details of ionization of a gas or vapor discharge tube are well covered in the literature we will only mention those matters that are directly related to low voltage ionization—but not inclusive of the thermonic or "hot cathode" type of unit. The present day cold cathode fluorescent lighting fixture does fall in the category of virtually being of the low voltage type of discharge tube, but since it requires a ballast because of the high starting voltage required (and, indeed, operates at voltages somewhat higher than normal line voltages) we delete any further reference to this type of discharge unit.

The starting potential or voltage drop across the gap of the two electrodes in an ionic discharge tube having unit length is dependent upon the product of the distance and the gas pressure. The minimum voltage that will cause a discharge between electrodes is observed to be a constant for most gases. (e.g. a definite number of molecules are required.) Greater molecular population will require a higher voltage; and, lowered molecular population will likewise require a higher voltage. Actual calculations (using Paschen's law) for the determination of this minimum voltage drop in an ionic discharge device, such as the low voltage fluorescent light bulb of this invention, have been made and give pressures that are not acceptable for a long life expectancy. Because of this a new determination was made in order to obtain the required distance (of electrode gap) to accomodate a substantial gas pressure for suitable long life expectancy. The result of this second set of calculations (using 3.5 to 4.0 mm Hg as the optimum fill gas pressure) gave a value to the gap of 0.0225 millimeters. This minute gap has been accepted and used in practice, here, for repeated test units. The starting voltages are quite uniform and are well within the limits of standard line service potentials.

Also, at this time I have adopted a standard gas fill pressure of 3.5 Torr Hg. (=466.66 Pa). The fluid mercury which is required to produce the necessary strong ultraviolet discharge is accurately measured, and I presently use 15.0 mg by weight. (It is a tiny globule having about a one millimeter diameter.)

All factors of my bulb are of importance, of course. But the matter of a satisfactory and useful long life expectancy does concern me. It prompts the same interest as the energy-saving topic.

A useful formula was developed by Machlett. He stated that the life expectancy of a gas discharge was in the order of the fill pressure squared; also, that there was a linear increase to its life extent as its length was increased (between electrodes). Machlett's formula, although an empirical one, has proven quite applicable. It has been used by several workers in the trade. It is used now to determine the life of my bulb.

Recently, on test at a filling gas pressure one-half that called out previously (or, $\frac{1}{2}\times 3.5$ Torr Hg) the low voltage bulb continued operating day and night for a period of 25 days and 8 hours. At that time a slight increase in its operating voltage was observed. (but one still below line potential). Also, it was noticed that a slight amount of sputter had taken place. Its lumen output, however, was somewhat higher. We will calculate the life expectancy of this unit using Machlett's formula. This is modified here because of certain constants that relate to the physical geometry of this unit. (Modifications: The volume of the bulb approximates 500 $cm^3$. But the volume occupied by the active discharge components, namely the positive column discharge source tubes, their respective cathodes and cathode extensions, and the small microdimensional starting gap assembly, is 80+ $cm^3$. Their difference gives a volume of 420 $cm^3$ which we will term the annulus gas reserve and gas ballast volume.)($VOL_{res.}$). The ratio of the reserve to the actively engaged volumes is 6.25. This value is a Multiplication Factor. It is a constant for this size of my bulb. Another multiplication factor is related to the half-wave operation of this type of low voltage ionic discharge. We assign an arbitrary value to it; letting it equal 1.5×. We now determine the life had that bulb been filled to the standard filling pressure.

From the above-

Let L E to be the Life Expectancy, in hours.

With 3.06=test fill pressure, squared.$(1.75)^2$

And 6.25=$VOL_{res.}$)

Also 608.0= . . . Term of life test, in hours, 1.75 mm./Torr.

Solution:

$L\ E=(1.75)^2\times(6.25)\times(1.5)\times(608)=17{,}442$ hours.

Remarks on this calculation are in order. The total is a conservative one. There are other factors which definitely effect an increase of this total. However it does represent two full years of continuous operation. Used 25% of the time, as the days pass, the life would then be eight years of useful life. And less than a half of the electrical energy would have been used. The life span as just calculated was stated as a conservative one. This by reason of the fact that this particular bulb still had an additional period of useful operation. Another related matter is that of the extremely short mean free path of mercury vapor.

Finally, regarding the life expectancy of this low voltage fluorescent light bulb are two more attractive characteristics: First, the operating bulb may be considered as having two separate compartments, or regions that is, with respect to operating temperatures. The ionic discharge ultra violet source tubes are at an elevated temperature as compared to the surrounding "annulus" space. Therefore, since the tops of all the source tubes are open and have free communication with the annulus volume, there must be molecular flow from the discharge region to the cooler surrounding annulus region—at least until equilibrium of both gas pressure and temperature may be reached. Equilibrium may or may not be probable. At any rate, until it may be established there is an exchange of molecules taking place. This, in part, qualifies my previous use of the terms "gas ballast" and "reserve volume." Second, the bulb has a fail-safe character. There are several pairs of the positive column ionic discharge source tubes operating in unison, in the case of a newly manufactured bulb. But, at the future date when efficiency may fall, or even outright failure, it can happen to only one pair at a time. This fail-safe feature can also advise the user that the bulb nears the end of its useful life.

I now prefer to make reference to FIG. 6 of this specification.

Were one to apply suitable direct current to the bulb it will be observed that only one discharge column of each pair will demonstrate ionic discharge. An explanation of this is to be presented in the following: Ionization taking place in a gaseous discharge tube is a process of collision between both the electrons that are emitted from the cathode and the ions that are coming from the anode as the applied electrical current flows. The cathode must be capable of the liberation of electrons. The anode, on the other hand, will liberate ions even if it is only a point of small wire so long as its current carrying capacity is within the limits of the applied current (amperes). Indeed, when this small anode is so constructed as to permit no reverse flow of current, then this same gas discharge tube when placed on alternating current would rectify that input and become a half-wave discharge.

FIG. 6 illustrates a condition wherein two unidirectional gas discharge tubes are paired, but polarized with respect to the flow of any current. Therefore, when an alternating current supply is applied, both of the paired tubes will demonstrate discharge; each one taking only one half of the applied alternating cycle of electricity. This pair, therefore, may be considered as being a full-wave rectifier. In my invention a plurality of these paired, polarized, and (geometrically) matched tubes are used in the one vacuum environment, or partial-gas and mercury vapor filled bulb.

In my drawing (FIG. 6 of this specification) it is to be observed that I have placed a resistance in series with one side of each of the paired and polarized discharge tubes. The reason and purpose for this resides in the fact that (per Ohm's Law) were there no resistance the power supply would "see" a resistance across each pair that would be evaluated from zero to infinity. And, were the power or electrical energy applied under this condition, the liberation of electrons from the cathode would very shortly result in a condition of a virtual short circuit. The bulb would immediately fail. Hence the use of these resistors. Fortunately, there is but a very slight voltage drop observed and measured across the resistance, and at the level of current that is allowed to flow through each pair there is little power loss due to their use in the circuit. The phrase which I have used previously, or . . . a series-parrallel circuit, becomes quite apparent from the drawing in FIG. 6.

THE PROCESSING OF THE LOW VOLTAGE FLUORESCENT LIGHT BULB

My drawing FIG. 7 of this specification shows the ultra-high vacuum system used and required for the processing of my bulb. It also includes the electrical equipment required. The Legend on the drawing defines the entire system by the use of the symbols used in the sketch.

It is necessary that emphasis be made concerning the ultimate low pressures that are developed and required for successful processing of my low voltage fluorescent light bulb. These low pressures (which will be called out presently) also must be of absolute dryness. Too, they must be developed, during the process, with reliability and promptness.

These required low pressures are:

From $7.5\times10^{-9}$ Torr up to $2.0\times10^{-8}$ Torr. (Hg).

This represents in terms of atmospheric pressure, NTP, a value of one ten-trillionth of one atmosphere! This is a must. First and somewhat briefly the procedure is outlined; then this will be summarized, and some detailed remarks will conclude this topic.

A batch of leak-tested bulbs are attached to the bulb manifold and roughed out using the RSVPump. When a vacuum of about one-tenth millimeters (Hg) is reached, the RSVPump is closed off and the valve to the USV-Pump is opened. The gauge, G, will soon indicate submicron pressures, but in the meantime the power supply adaptor receptacles, R, are attached to the leadwires of all the bulbs. The oven is then lowered over the bulbs. It is "riding" at a steady temperature of 360° C. Slight pressure increases may be observed for a short time but within three to five minutes it will again indicate a definite submicron pressure. The first prebake is allowed to continue for about ten minutes. The oven is then lifted upward sufficient to see the bulbs. The oven could be provided with glass ports. In this case it need not be raised at this time. The valve to the USVPump is closed off and 4 or 5 mm of helium gas, F He, is allowed into the manifold and the bulbs. The low voltage power transformer, L.V.Xform., and its auxilliary rotary switch, R Sw., is turned on and the paired source discharge in all bulbs are internally bombarded. The bombing current may be as high as, say, 250 MA and soon the cathodes will assume a dull red color. The discharge color in the columns above the cathodes would have shown a characteristic helium color (salmon pink) when the internal bombardment was started. However, it may change to a bluish color discharge as the cathode temperature is elevated. When the cathodes demonstrate a temperature of about 700° C. by their redness, the internal bombing is discontinued and the valve to the USV-Pump is opened again. The high frequency (induction heating) is now used with the evacuation continued during the time required to again elevate the temperature of all cathodes in all bulbs to about 700 to 800 degrees, C. Obviously, it is necessary to raise the oven in order to get at the individual bulbs for this external bombing and heating. A second oven bakeout is now applied. This bakeout can be a five minute period. The internal bombardment is then repeated for a second and final bombardment. The gas pressure, again using helium, can be lower for this second internal bombardment. One and a half to two millimeters, Hg, is enough. This time, the characteristic helium color should persist, using, say, 150 to 175 MA. However, were the helium color to fade and become the bluish color mentioned above, the bulbs will require at least one more bakeout, and one more internal bombardment. Seldom is it necessary to give the bulbs a third internal bombardment. The vacuum in the bulbs, following these steps of both the internal and external bombing of all cathodes should be allowed to reach the low pressure level of from $7.5\times10^{-9}$ to $2.5\times10^{-8}$ Torr. This pressure can not be attained unless the bulbs are of excellent purity.

When the degree of vacuum as stated is reached the bulbs are "filled" and are then tipped off (sealed off). The matter of the injection of the small globule of mercury will be covered in the following; (This mercury injection operation follows the fill and seal off operations.)

There are several methods of providing the fluid mercury. Originally, the practice of merely putting a small quantity into the unit prior to the processing was used. And the results in a sense were satisfactory, at that time. Soon it was learned that this method had to be improved. Darkening of the discharge tube (called solarization in the trade) was observed as taking place in a short period of time. Then the method of providing mercury contained in a side-arm of the tubulation of the unit was found to give better results. Still higher quality was effected when it was practiced, in the last instance of the use of a side-arm reservoir member, that to gently heat the bulbous portion containing fluid would accomplish the improved results. Doubtless, there are other methods practiced (in mass production cases) of providing the mercury fluid contained in a suitably shaped and sealed pellet or pill material (metal) and to release the vapor by induction heating. (e.g. This last method being similar to the well-known method of releasing a "getter" material from its pill type container.). These methods, and the choice of one or the other of them are matters left to so-called quality control. It must be pointed out, however, that in any case that involves an external application of heat during the processing of the unit, a means of protecting the mercury fluid from vaporizing prematurely must be used. Presently, I use the side-arm method and gently preheat the fluid during the first rough out evacuation. Then, the entrapped fluid contained in this side-arm is covered with a water soaked asbestos paper jacket. The latter is several thicknesses of the asbestos paper and, under normal periods of heatup during my processing, protects the mercury from vaporizing up into the bulb's tubulation or the bulb itself. The water soaked jacket fits the mercury side-arm snugly.

Figure 1:
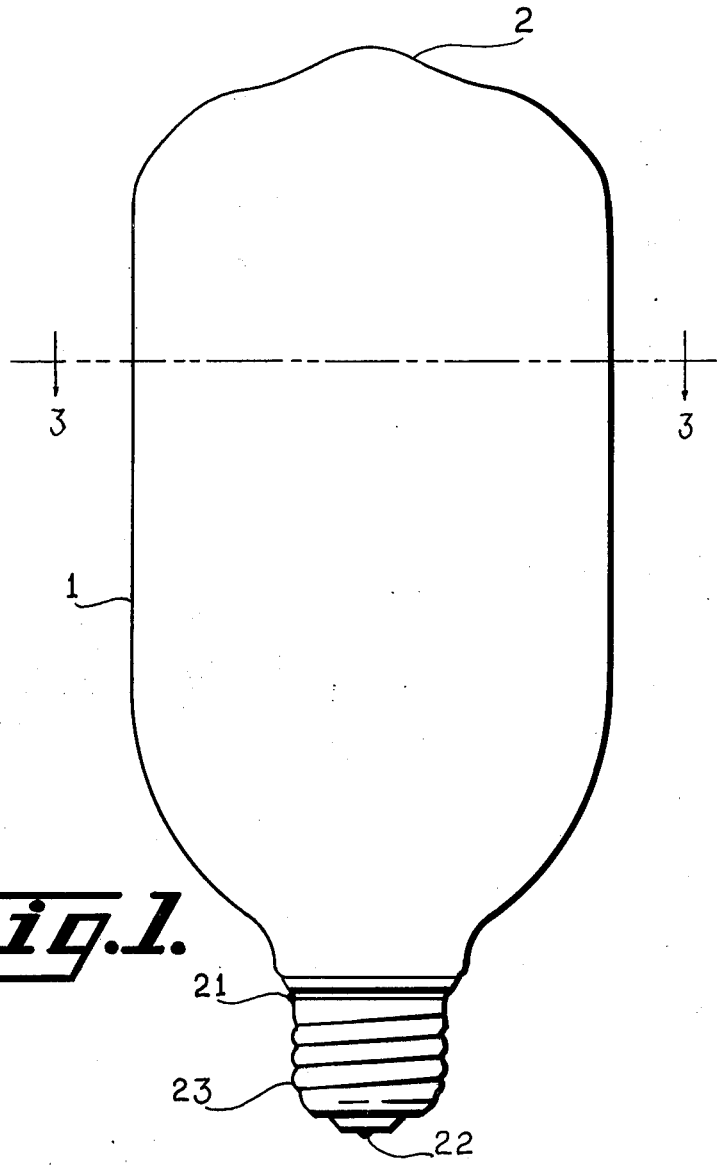
Figure 2:
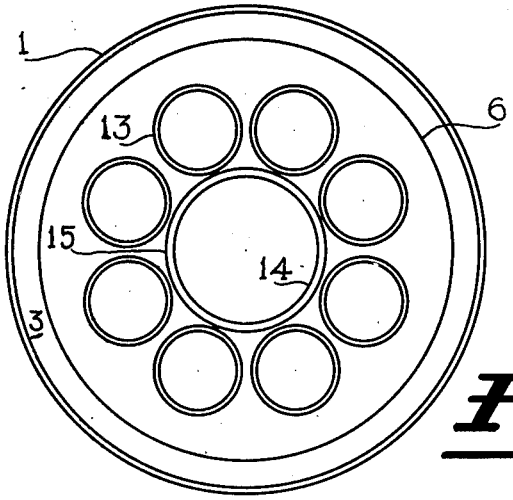
FIG. 2 is a plan view of the low voltage fluorescent light bulb on line 1—1 of FIG. 1.
Figure 3:
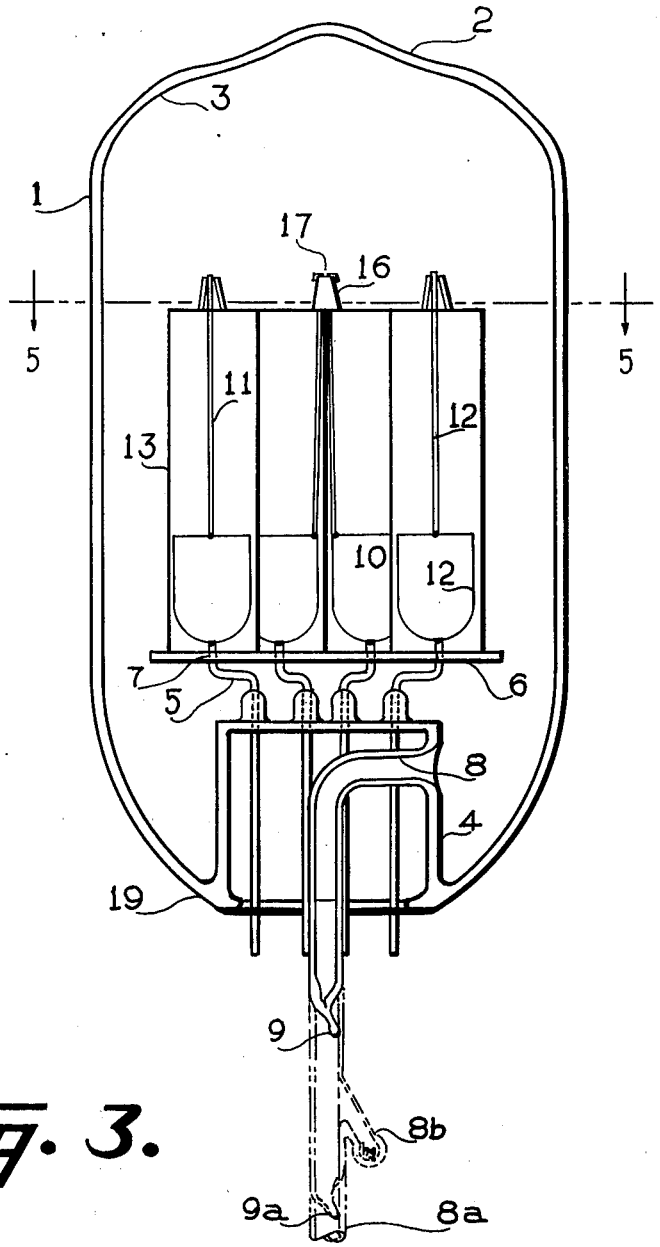
FIG. 3 is a vertical section through the axis of the low voltage fluorescent light bulb.
Figure 4:
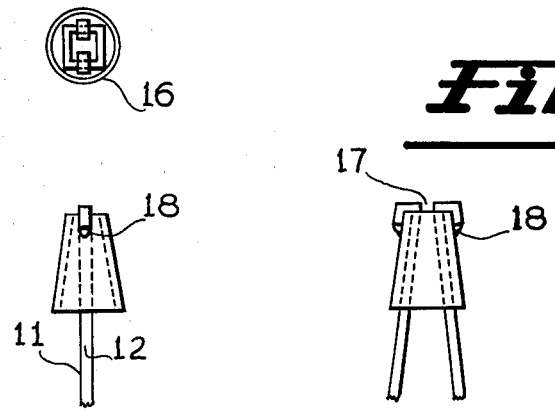
FIG. 4 is a three-view working drawing of one microdimensional starter gap spacer components of the low voltage fluorescent light bulb. This drawing is of exaggerated scale as sketched.
Figure 5A:
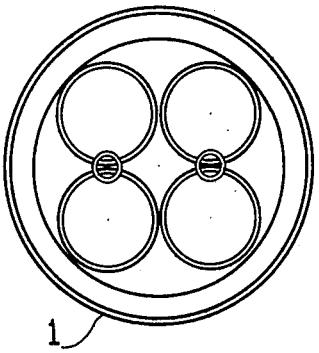
FIGS. 5A, 5B, 5C and 5D are plan views of four sizes of the low voltage fluorescent light bulb on line 5—5 of FIG. 3.
Figure 5B:
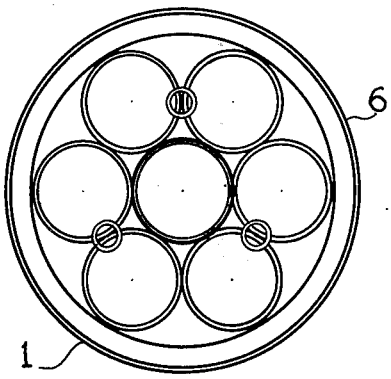
Figure 5C:
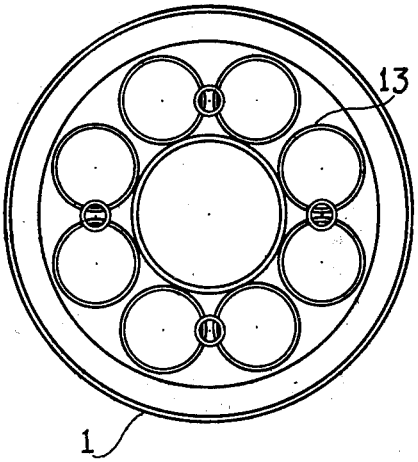
Figure 5D:
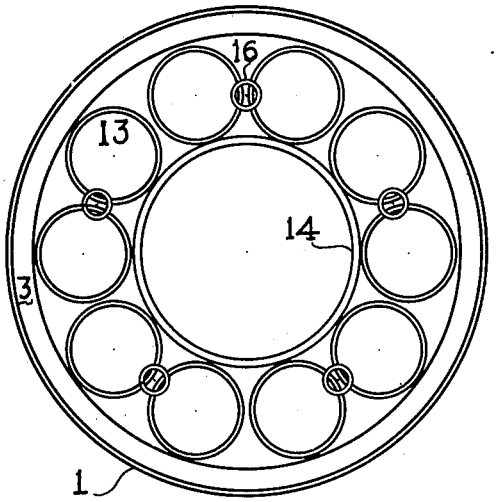

In the portion of this specification that enumerates, in detail, the components and parts of my low voltage fluorescent light bulb, member 8, the tubulation, is drawn (See FIG. 3) providing a sufficient length, indicated by location lines, *8a*, to enable the side-arm mercury reservoir member *8b* to be formed and receive the mercury prior to processing. The mercury is indicated by its symbol Hg in the drawings with reference to the bulbous portion of side-arm *8b*. Therefore, the first seal off, or tip off, is performed at *9a*. Then following the operation of allowing the fluid mercury to flow into the main bulb's interior; the final tip off is performed at 9.

PROCESSING TIPS AND SUGGESTIONS

A few remarks will follow. It is my purpose to present any information that will be of assistance in the successful practice of my invention.

Basically, the process is the simple matter of removing all impurities from all components contained in the bulb; converting the cathodic coating material (carbonates) to their respective oxides (oxides of strontium, barium and calcium); the production of an ultra-high vacuum condition following these previous steps, and the "filling" the bulb with a small amount of an enert gas with the addition of a bit of mercury. Finally, the bulb is sealed off.

To accomplish these end results the bulb is bombarded internally (ionization at a relatively higher current level than that of normal bulb current, in operation) and then the evacuation of the impurities liberated by the bombing is effected with vacuum pumping. The bulb is also externally bombed with the use of the high frequency power unit. This is primarily done for the express purpose of uniform conversions of the cathodic coating material. The glass components limit the temperature to which the bulb may be heated in the oven. The major source of residual impurity in all cases involving the use of glass for the vacuum treated device is water-vapor. Indeed, at the maximum temperature (safe with regard to softening under vacuum conditions) that has been stated, or 360° Cent., the glass itself will be releasing water-vapor in appreciable quantities. Were the temperature elevated to a higher level this water-vapor evolution would increase, the increases of released water-vapor with still higher levels of temperatures being quite logarithmic. Therefore, we must have a vacuum system capable of high speed removal of water-vapor, during the entire processing of the bulb.

With respect to the temperatures produced during internal bombarding of the unit, the critical consideration is the gas and vapor pressures existing at that time. The fill pressure of, say, 4 or 5 millimeters of helium used for the start of the first internal bombardment, will immediately increase due to the heat that is developed at the cathodes, their extensions and the gaps. Were the gaps to become bright orange red hot, this means that the pressure has increased too much. The valve to the pump is opened a bit to reduce the pressure. However, relatively high pressure is useful to attain maximum tube (quartz positive column discharge tube) temperatures. Once this is accomplished lowered pressures are used in order to heat up the entire cathode, or all cathodes. The quartz will withstand temperatures far above those produced. Indeed, the metal of the cathode could melt and the quartz would remain intact. The temperature that we wish to develop at the cathode, both to purify the metal and to convert the electron emissive coating, has been stated. It is below the softening point of the cathode metal. In general, the final uniform visible red-orange heat of the cathodes is best obtained when the valve to the pump is allowed to remain open—at least partially.

As one precaution, there is a condition of too low a gas or vapor pressure. This invites the Hittorf Effect to a drastic degree, and at the current of bombardment being used the bulb would demonstrate damage across the leadwires (feedthroughs) of the stem.

The use of the high frequency bombing equipment is quite another matter. It is of course necessary that the unit be tuned for the "load" that is to be induction heated. In the case of the low voltage fluorescent light bulb, since there are several sizes, the adjustment of the unit must be made each time a different size is processed. The important matter is that the vacuum state of the bulbs must be at very low pressures to accomplish a uniform conversion of the electron emissive chemicals. The first internal bombing did, of course, convert them to an appreciable degree—if the visible red-orange color was reached at the cathodes. But the high frequency at high vacuum will accomplish an excellent and a uniform temperature elevation to the proper level. If the cathode emissive coating has not been rather thoroughly converted during the first internal bombardment it will be observed that an ionic glow will develop about the cathodes during attempts to elevate the cathode temperature to the required one. At this time the high frequency is stopped and the bulb is allowed to be pumped to lowered pressures. (e.g. The vacuum system is left open during the entire high frequency induction heating.)

If a metal manifolding and vacuum system is used one will have to rely upon the gauge to indicate pressure surges—or, even possible leakage. However, when the system is made of, say, borosilica grade of glass it is general practice to have a hand Tessla coil for a quick determination of pressure conditions within the system. Especially in the region of the bulbs being processed.

Since the final filling pressure is considered as critical to the success of the bulb, the gauge used for the measurement of this pressure must be one that is accurate to an absolute degree. The Baratron Pressure Gauge ®, one of diaphragm-capacitance type, having the range of from one to ten Torr (1.0 to 10.0 mm hg) is quite satisfactory. On the other hand the McLeod Gauge is excellent; but perhaps not as convenient.

If the bulbs are processed in an area that is more than a few hundred feet above sea-level, corrections for that local altitude must be made in order to fill the bulb accurately.

INVENTOR'S STATEMENT OF: PRIOR STATE OF THE ART

To the best of my knowledge and belief the following list presents identified inventions of the prior state of the art. It is considered as related to this specification, namely, the LOW VOLTAGE FLUORESCENT LIGHT BULB. A brief summary of each invention, as listed, will follow the list.

| | |
|---|---|
| | Respectfully submitted<br>Edwin E. Eckberg - Applicant<br>5504 Currier Circle<br>Boise, Idaho 83705. |
| January 1978. | |
| 1. LOW VOLTAGE NEON LAMP - BULB. | Raymond R. Machlett, Inventor<br>Assigned to: RAINBOW LIGHT, INC.<br>About 1929 to 1930 U.S. Pat. |
| 2. UNIDIRECTIONAL GAS DISCHARGE SYSTEM - | Miles W. Pennybacker Inventor<br>Assigned to: VOLTARC TUBES, INC.<br>About 1932 to 1933 U.S. Pat. |
| 3. GAS LASER TUBE SYSTEM | Edwin E. Eckberg, Inventor<br>Full Title retained (Self).<br>U.S. Pat. No. 3447098<br>27th MAY 1969 |
| 4. UNIFIED SYSTEM VACUUM PUMP | Edwin E. Eckberg Inventor<br>Full Title retained (Self).<br>U.S. Pat. No. 2954157<br>24th SEPTEMBER 1963 |

SUMMARY

Re: 1. The low voltage neon lamp of MACHLETT'S invention was limited to a single pair of positive column discharge (ionic) neon gas tubes. It used a starting strip, but required a caesium chemical to accomplish low voltage operation. A few hundred thousand bulbs were produced, and sold. The Stock Market "crash" resulted in the abandonment of this product. It had a life of approximately two or three thousand hours. Sputter commenced during early life period. I was assistant to Mr. Machlett, and later was responsible for the processing of these bulbs. The bulbs, mostly, were used for sign and display purpose.

RE: 2. The unidirectional gas discharge system of PENNYBACKER'S invention was one that was only applicable to high voltage neon tubes. Normal neon tube units, up to this time, had been bidirectional and, of course required a high impedance high voltage transformer for their operation. Pennybacker's system was used to both increase the footage per transformer, and to extend the life of a neon discharge tube. Again, even though it was an energy saving invention it was rather poorly accepted by the trade. Doubtless, again, because of the Depression which followed the crash. I was Pennybacker's first employee, and worked in the research and production areas of his company. His unidirectional tube, in use was used as separate unit discharge neon tubes; but they were connected in a series-parallel manner—on the high voltage type of transformer stated above. (e.g. They were half-wave tubes.)

RE: 3. The gas laser tube system of ECKBERG'S invention was one that was applicable to either high voltage operation, or if made in a special manner it could also be used on normal line, single phase currents. In the latter instance the invention made use of an improvement over Machlett. Instead of a strip being used for the starting device, a micro-dimensional tubular member was used. The low voltage gas laser tube (when made) was used only a short time. The optics involved have continued in use. The half-wave feature did not deter the unit from lasing. It was used mostly as a demonstrator of for instructional purpose.

RE: 4. The unified system vacuum pump of ECKBERG'S invention is a fast ultra-high vacuum pump. The extreme low pressure that is developed using the pump is one that is dry. There is no back-streaming, indeed, it is considered impossible. The reference to this invention, in this present instance, is that it is the one type of vacuum system that will meet the requirements set forth in the specification for the processing of the low voltage fluorescent light bulb. It also may be pointed out that, since it is a vacuum system that normally requires no liquid nitrogen trap, and is a single mechanical system, it is economical to use. It is driven by a 2 hp 3400 rpm motor. The drive is direct.

Having thus described my invention, that which I wish to secure by Letters Patent is covered in the following claims:

1. A fluorescent lamp comprising
   - an envelope having a fluorescent coating on the inner surface thereof and sealed at one end by a reentrant stem member;
   - a plurality of lead wires extending through said reentrant stem member;
   - platform means mounted on said lead wires;
   - reflector means substantially centrally mounted on said platform means;
   - a plurality of pairs of tubular members mounted on said platform means and surrounding said reflector means;
   - cathode means mounted within each of said tubular members, each said cathode means comprising a base cathode member and an extended cathode member extending from said base cathode member to the upper end of its associated tubular member, said base cathode member and said extended cathode member having an electron emissive coating therein;
   - spacer means mounted in association with the upper ends of each pair of said tubular members, the extended cathode members of each said pair of tubular members being attached at their upper ends to the spacer means associated therewith so as to form a gap having a selected dimension between the upper ends of said extended cathode members; and said cathode means being capable of energization by a voltage source via said lead wires.

2. A fluorescent lamp in accordance with claim 1 and further including an inert gas therein at a partial pressure substantially at a level of 3.30 Torr, said inert gas providing an initial media for the ionic starting discharge of said lamp.

3. A fluorescent lamp in accordance with claim 1 and further including mercury fluid of about 15 milligrams by weight for providing ultraviolet radiations during normal operation of the bulb, said ultraviolet radiations causing said fluorescent coating to fluoresce said mercury fluid vaporizing during operation so as to dominate the ionic discharge within the lamp.

4. A fluorescent lamp in accordance with claim 1 wherein said gap is selected to be between 0.01 and 0.05 millimeters.

5. A fluorescent lamp in accordance with claim 4 wherein said gap is selected to be about 0.0225 millimeters.

* * * * *